US006575666B1

(12) United States Patent
Janesky

(10) Patent No.: US 6,575,666 B1
(45) Date of Patent: Jun. 10, 2003

(54) CRAWLSPACE ENCAPSULATION SYSTEM

(76) Inventor: Lawrence M. Janesky, 11 Fawn Meadow La., Huntington, CT (US) 06484

( * ) Notice: Subject to any disclaimer, the term of this patent is extended or adjusted under 35 U.S.C. 154(b) by 0 days.

(21) Appl. No.: 10/165,458

(22) Filed: Jun. 7, 2002

(51) Int. Cl.[7] ..... E02D 19/00

(52) U.S. Cl. ..... 405/270; 52/169.14; 52/169.5; 405/229

(58) Field of Search ..... 405/270, 229; 52/169.5, 169.14

(56) References Cited

U.S. PATENT DOCUMENTS

| | | | | | |
|---|---|---|---|---|---|
| 462,953 | A | * | 11/1891 | Jackson | 52/169.14 |
| 997,835 | A | * | 7/1911 | Lane | 52/302.1 |
| 2,017,106 | A | * | 10/1935 | Sandel | 428/175 |
| 2,145,284 | A | * | 1/1939 | Anderson et al. | 52/169.14 |
| 2,899,771 | A | * | 8/1959 | Burris, Jr. | 52/169.14 |
| 3,424,647 | A | * | 1/1969 | Callahan et al. | 442/324 |
| 3,445,322 | A | * | 5/1969 | Saiia et al. | 428/178 |
| 4,735,838 | A | * | 4/1988 | Roberts et al. | 428/40.3 |
| 4,843,786 | A | * | 7/1989 | Walkinshaw et al. | 52/169.5 |
| 4,878,421 | A | * | 11/1989 | Glasser | 454/354 |
| 4,897,313 | A | * | 1/1990 | Wiercinski | 428/489 |
| 4,907,386 | A | * | 3/1990 | Ekroth | 52/169.14 |
| 4,915,542 | A | * | 4/1990 | Fernando | 405/150.1 |
| 5,054,252 | A | * | 10/1991 | Newman | 52/169.14 |
| 5,331,782 | A | * | 7/1994 | Wohlgemuth | 52/169.7 |
| 5,543,188 | A | * | 8/1996 | Te'eni | 428/36.6 |
| 5,551,797 | A | * | 9/1996 | Sanford | 405/36 |
| 5,763,036 | A | * | 6/1998 | Terry et al. | 428/40.1 |
| 5,806,252 | A | * | 9/1998 | Scuero | 52/169.7 |
| 5,890,845 | A | * | 4/1999 | Buonaiuto et al. | 405/268 |
| 6,238,766 | B1 | * | 5/2001 | Massett et al. | 428/99 |
| 6,308,486 | B1 | * | 10/2001 | Medland | 52/506.05 |
| 2001/0000371 | A1 | * | 4/2001 | Traxler | 52/169.14 |

OTHER PUBLICATIONS

"St Louis Department of Public Works Single–Family Checklist", Jan. 25, 1999, 1st 9 pages.*

State of Florida, Dept of Consumer Affairs, Radon Program, "Florida Standards for Radon–Resistant New Commercial Building Construction" Jan. 23, 1996, 22 pages.*

* cited by examiner

*Primary Examiner*—J. J. Swann
*Assistant Examiner*—Katherine Mitchell
(74) *Attorney, Agent, or Firm*—Perman & Green, LLP

(57) ABSTRACT

A system for encapsulating a crawlspace against the entry of sub-soil water vapor and also against the entry of external ground water from the crawlspace walls and for completely isolating the building from water vapor from the earth. The present system comprises applying over the floor of the crawlspace, generally a dirt floor but sometimes a poured concrete floor, a continuous durable sealed plastic film barrier layer or laminate, and extending the barrier film vertically-upwardly to cover and seal the interior peripheral walls enclosing the crawlspace to an elevation at least slightly greater than the elevation of the ground in contact with the exterior surfaces of the peripheral walls and preferably to the tops of the peripheral walls. This encapsulates the dirt surface of the entire crawlspace against the penetration of external ground water or floor water and also sub-soil water and water vapor onto the surface of the plastic barrier film and into the crawlspace atmosphere.

13 Claims, 1 Drawing Sheet

CRAWLSPACE ENCAPSULATION SYSTEM

BACKGROUND OF THE INVENTION

1. Field of the Invention

The present invention relates to a novel and efficient system for preventing the entry of ground moisture into so-called crawlspaces of buildings such as homes. Moisture is very damaging to wood structural support members of buildings and is absorbed by such members from the ground and from moist air in contact therewith.

Many buildings and homes are built without basements, and are elevated a few feet above the ground on support members such as stone, poured concrete or concrete block walls. In many cases the crawlspace between the ground surface and the wooden floor beams or joists of the house is at a level below the level of the surrounding soil, or below the level of saturated soils in wet weather, so that water flows into and is absorbed up through the floor of the crawlspace, usually a dirt surface, from adjacent ground areas of higher elevation and up from the sub-soil. Such water is drawn into the headroom of the crawl space in the form of water vapor and penetrates the wooden structural members of the building, causing wood rot, mold, odors, attraction of ants and other insects, rodents etc. Also, the escape of dangerous radon gas from the ground into the crawlspace and into the building is another problem.

Even in crawlspaces that do not leak or flood from groundwater, the earth below the crawlspace, and forming the floor of the crawlspace, has a high humidity level most of the time, and this water vapor rises into the crawlspace to produce a humid air atmosphere within the crawlspace, which moves upwardly to penetrate the structural framing and living spaces above the crawlspace.

Mold spores exist in air and grow into destructive mold in the presence of organic material, such as moist wood. Humidity levels of from 50% to 90% are common in crawlspaces, even those that have never flooded. Mold can grow on dirt, insulation, wood framing and even under carpeting on the floor within the home. Mold digests and destroys organic materials as it feeds on them. Damp environments also provide an inviting environment for insects such as termites, ants and similar critters which feed on moist organic material such as structural support wood and can contribute to the destruction and collapse thereof.

2. State of the Art

In an effort to prevent the penetration of water and water vapor into building crawlspaces it has been proposed to apply a continuous moisture barrier layer such as a thick plastic film over the dirt floor of the crawlspace. This has been proven to be unsatisfactory, per se, since water is drawn up from the ground, beneath the barrier, and leaks and/or vaporizes around the edges of the barrier into the crawlspace environment. Also, ground water penetrates the walls of the crawlspace and/or otherwise enters the crawlspace and accumulates on top of the vapor barrier film and generates moisture which permeates into the wooden structural supports of the building resulting in rot and decay, mold and fungus, odors and vermin.

U.S. Pat. No. 5,6.42,967 discloses a system in which the barrier film is associated with an excavated pit filled with aggregate.

Water entering the crawlspace collects in the pit and is pumped from a sump when necessary. A vapor barrier film is applied over the dirt floor of the crawlspace, and over the pit and sump areas, to prevent moisture from entering the building. Such a system is unsatisfactory because it has no means for preventing the entry of ground water and its accumulation on the surface of the barrier film, with the disadvantages discussed supra.

U.S. Pat. No. 5,890,845 discloses another system in which the dirt floor of a crawlspace is covered with a layer of lightweight concrete material applied over a plastic film barrier layer. While the barrier layer blocks the penetration of moisture from the ground up into the crawlspace, the system provides no means for preventing the entry of ground water through the walls of the crawlspace onto the surface of the concrete material where it can accumulate in surface depressions and develop moisture, with the disadvantages discussed supra.

In summary, there is a need for a system which prevents the entry of water from the sub-soil and also from higher elevations of the surrounding ground, such as excessive ground water caused by rain, snow and/or flooding, into crawlspaces directly or through concrete block walls which surround and enclose the crawlspace.

SUMMARY OF THE INVENTION

The present invention provides a novel simplified system for waterproofing a crawlspace against the entry of sub-soil water vapor and also against the entry of external ground water from the crawlspace walls and further completely isolates the building from water vapor from the earth. The present system comprises applying over the floor of the crawlspace, generally a dirt floor but sometimes a poured concrete floor, a continuous sealed plastic film barrier layer, and extending the barrier film vertically-upwardly to cover and seal the interior peripheral walls enclosing the crawlspace to an elevation at least slightly greater than the elevation of the ground in contact with the exterior surfaces of the peripheral walls and preferably to the tops of the peripheral walls. This encapsulates the dirt surface of the entire crawlspace against the penetration of external ground water or flood water and also sub-soil water and water vapor onto the surface of the plastic barrier film and into the crawlspace atmosphere.

According to an embodiment of the invention the dirt surface of the crawlspace may be first provided with a sump pit and/or a drainage trench system for the collection of sub-soil water that leaks in from the crawlspace floor or walls under the barrier layer. A perimeter drain conduit or sump pump may be associated with the sump pit or drainage trench, depending upon the degree of wetness of the crawlspace and the grade and elevation of the exterior ground surrounding the floor of the crawlspace, to discharge excessive amounts of water accumulated beneath the barrier layer to areas exterior to the crawl space.

BRIEF DESCRIPTION OF THE DRAWINGS

The foregoing aspects and other features of the present invention are explained in the following description taken in connection with the accompanying drawings wherein.

DETAILED DESCRIPTION OF THE PREFERRED EMBODIMENT

Figure 1:
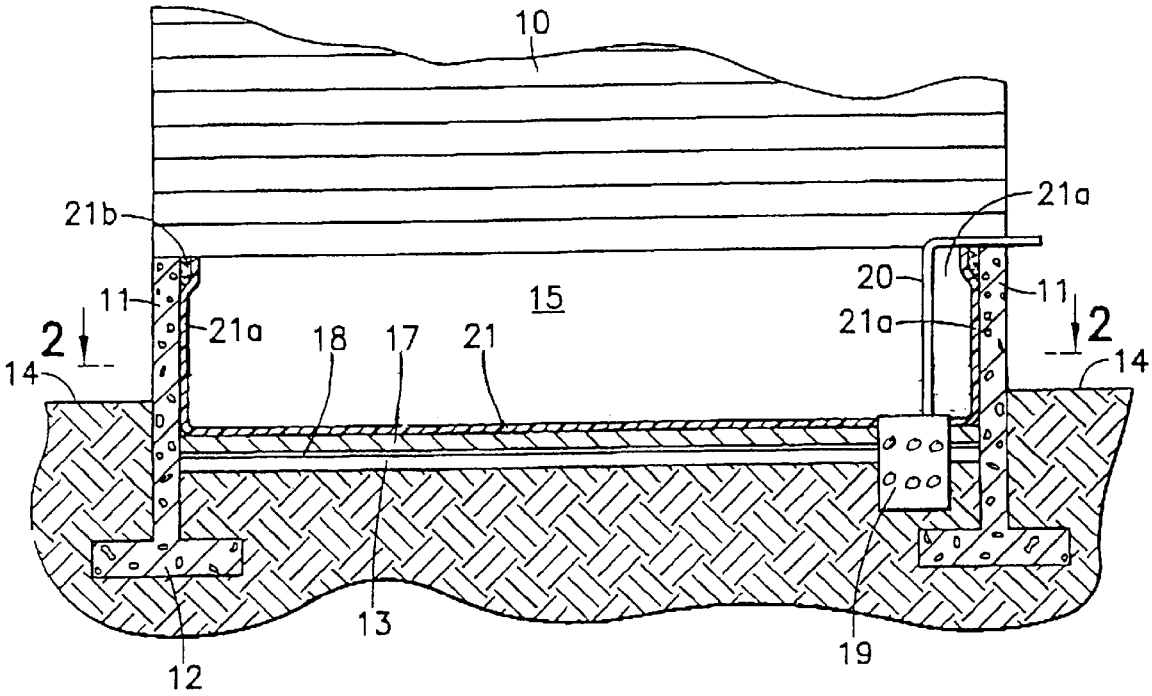
FIG. 1 is a side elevational view of a building having a crawlspace encapsulated according to one embodiment of the present invention, shown partially in cross-section.
Figure 2:
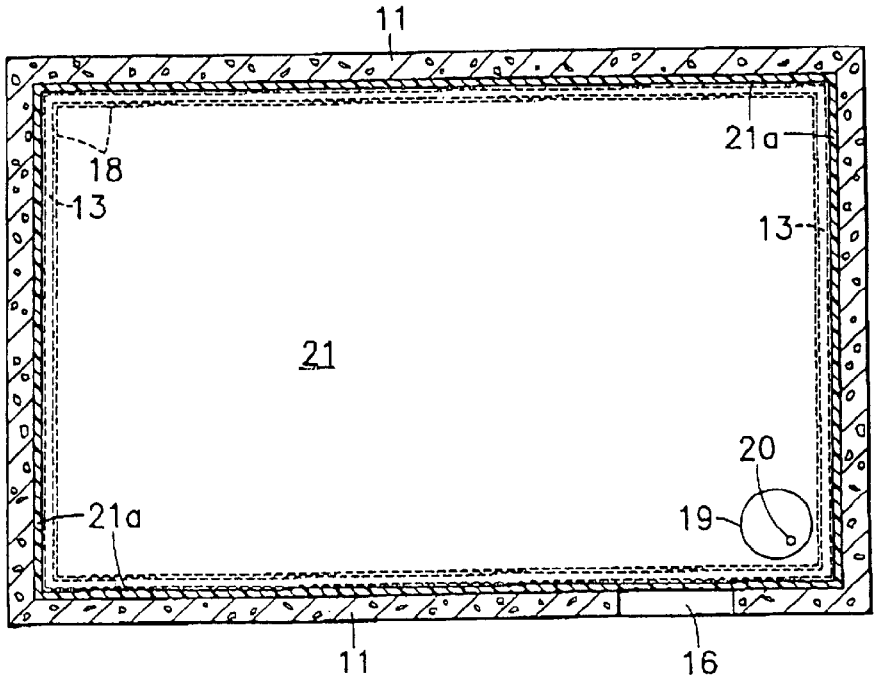
FIG. 2 is a view of the crawlspace, taken along the line 2—2 of FIG. 1.

Referring to the drawings, a building 10 such as a house is illustrated supported upon peripheral foundation walls 11 such as cement block wall on a peripheral footing 12 buried in the ground beneath the frost line. Also, an access opening 16, shown in FIG. 2, preferably is provided in the foundation 11, above ground level, or a hatch door is provided in the roof or ceiling to permit access into the crawlspace when necessary. Any air vents present in the crawlspace walls 11 or foundation optionally may be sealed or covered with the crawlspace liner since air circulation is not important after the crawlspace is sealed.

According to an embodiment of the present invention the relatively level floor 17 of the crawlspace may be provided with an inner peripheral water drainage trench 18 or tile filled with aggregate and preferably containing a perforated water drainage conduit 13. Trench 18 may open to a sump pit 19 which, depending upon the slope of the terrain, may contain a sump pump and a discharge pipe 20 which extends up and over the foundation and drains to an external location whenever the water level of the sump pit 19 rises to the activation level of the sump pump. Preferably, the sump pit 19 may comprise a sump reservoir containing a conventional lever-activated sump pump. The incorporation of the drain pit, aggregate-filled water tile and/or sump pit or pump is preferred in installations where excessive amounts of water may be drawn up to the dirt floor 17 of crawlspace and/or may penetrate the cement block foundation 11, above or below ground level, and enter the crawlspace and accumulate beneath the barrier layer.

Even in systems in which the floor of the crawlspace is formed of poured concrete, water vapor can penetrate up into the crawlspace at the wall/floor interface or through cracks in the floor, from the dirt soil therebeneath.

Yet another feature of the present invention involves the discharge or release of dangerous radon gas from beneath the plastic liner where it can accumulate by migration up from the sub-soil. This feature involves the attachment of one end of a radon-discharge conduit through the plastic liner and sealed thereto, the other or discharge end being extended up and over the foundation and to the exterior atmosphere for the safe release of the radon gas. Preferably the discharge end of the conduit is associated with a continuously-operating fan which draws the gas from beneath the plastic liner and out into the atmosphere. Alternatively, the radon discharge conduit can be positioned between the foundation and the plastic liner from beneath the liner up over the foundation and out to the discharge end and the exterior atmosphere.

The essential element of the present system is a continuous sealed crawlspace liner 21, such as of plastic film, which may be a monofilm but preferably is a 16 mil thick durable heavy duty, fiber-reinforced multi-ply plastic film or rubber sheeting. The crawlspace liner 21 is installed over the dirt floor 17 and over the sump pit 19, if present, and is extended vertically-upwardly to the tops of the crawlspace walls and sealed against the inner surface of the foundation walls 11 peripherally surrounding and enclosing the crawlspace, as illustrated by the drawings. The upper surface of the liner may be white in color to brighten the crawlspace.

The vertical peripheral crawlspace liner extensions 21*a* are extended and supported against the inner surfaces of the foundation walls 11 and sealed thereto at an elevation which is above the exterior ground level, preferably to the tops of the foundation walls. The continuous marginal liner extensions 21*a* are sealed or bonded to each other and to the entire peripheral inner wall of the foundation 11 adjacent the top thereof by means of an adhesive tape or a continuous bead of suitable adhesive or caulk composition such as a polyurethane composition. Preferably, nylon fasteners are used to support the liner 21 vertically over the foundation 11 during installation and prior to caulking. The essential purpose of the crawlspace liner 21 and its extended marginal border areas 21*a* is to prevent the entry of water vapor from the soil or ground into the crawlspace environment and to prevent external ground water or flood water entry into the crawlspace and on top of the crawlspace liner 21, over the dirt floor 17, where it can become trapped and stagnant and can generate mold and fungus and water vapor which can deteriorate and rot structural wood support members of the building 10. The crawlspace liner 21 is sealed adjacent the top of the foundation peripherally, at least adjacent the uppermost edges of the liner extensions, 21*a* by a continuous sealing bead 21*b*, as illustrated. Any exterior ground water which might penetrate the foundation 11, such as through a cement block wall, is trapped beneath the liner extensions 21*a* and flows down into the dirt floor of the crawl space and into the drain tile pit 18, if present. This keeps the head space 15 of the crawlspace, or the crawlspace environment, dry.

The crawlspace liner 21 may be an integral continuous durable water barrier film or laminate or may be formed of wide strips of such film or laminate, such as six feet in width, which are overlapped and sealed along the edges thereof with the waterproof caulk or adhesive or adhesive tape to provide a continuous sealed barrier liner 21 of the required dimensions. The installed crawlspace liner totally encapsulates the crawlspace environment and completely isolates the building envelope and upper living spaces from the earth therebelow and from the dampness, insects and radon contained therein, to provide a healthier home environment. The liner 21 must be sufficiently durable to resist tearing and piercing under the weight of installers.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An encapsulation system for preventing the penetration of water vapor and ground water into the crawlspace environment of a building, said crawlspace environment having a floor surrounded by a substantially continuous peripheral foundation enclosing said crawlspace environment beneath the building, said system comprising a continuous sealed plastic liner barrier layer covering the entire floor of the crawlspace to provide a barrier against the penetration of groundwater and water vapor up through the floor and into the air space of the crawlspace, said barrier layer having vertical extensions which extend vertically up against the interior peripheral foundation to a height greater than the corresponding ground level at the exterior surface of the foundation and which are bonded to the interior peripheral foundation by a continuous seal adjacent the upper edges of said extensions to provide a continuous barrier against the penetration of exterior groundwater through said foundation and water vapor from said floor and into said crawlspace environment.

2. An encapsulation system according to claim 1 in which said plastic liner barrier layer is a multi-ply, fiber-reinforced, durable plastic film laminate.

3. An encapsulation system according to claim 2 in which the multi-ply durable barrier layer comprises at least one layer of rubber sheeting.

4. An encapsulation system according to claim 1 in which the floor of the crawlspace is a dirt floor provided with a peripheral water drainage trench adjacent the interior wall of the foundation and beneath the barrier layer to collect and drain any ground water which penetrates the peripheral foundation.

5. An encapsulation system according to claim 4 in which the dirt floor of the crawlspace is further provided with a sump pit, with which the peripheral drainage trench communicates, to drain excessive amounts of ground water thereinto from said drainage trench.

6. An encapsulation system according to claim 5 in which said sump pit includes a sump pump and a drain conduit for pumping excessive amounts of ground water from the crawlspace environment.

7. An encapsulation system according to claim 4 in which the peripheral water drainage trench contains a perforated water drainage conduit.

8. An encapsulation system according to claim 1 in which the water barrier liner is formed from two or more wide strips of barrier layer material having their edges overlapped and united by a continuous seal.

9. An encapsulation system according to claim 1 further comprising a radon-discharge conduit communicating with the underside of the crawlspace liner for releasing radon gas to the external atmosphere, said discharge conduit communicating with a continuously-operating fan.

10. An encapsulation system according to claim 1 in which the floor of said crawlspace is a concrete floor.

11. An encapsulation system according to claim 10 in which the crawlspace is provided with a peripheral water drainage trench beneath the concrete floor and opening to a sump pump and water discharge conduit.

12. An encapsulation system according to claim 1 in which said plastic liner has a brightly-colored upper surface which brightens the crawlspace environment.

13. An encapsulation system according to claim 1 in which the vertical extensions of the plastic liner barrier layer extend to a height adjacent the top of the interior peripheral foundation and are bonded thereto adjacent the top thereof.

* * * * *

US006575666C1

(12) EX PARTE REEXAMINATION CERTIFICATE (6528th)

United States Patent

Janesky

(10) Number: US 6,575,666 C1

(45) Certificate Issued: Nov. 18, 2008

(54) CRAWLSPACE ENCAPSULATION SYSTEM

(76) Inventor: Lawrence M. Janesky, 11 Fawn Meadow La., Huntington, CT (US) 06484

Reexamination Request:
No. 90/008,194, Nov. 10, 2006

Reexamination Certificate for:

| | |
|---|---|
| Patent No.: | **6,575,666** |
| Issued: | **Jun. 10, 2003** |
| Appl. No.: | **10/165,458** |
| Filed: | **Jun. 7, 2002** |

(51) Int. Cl.

| | |
|---|---|
| ***E02D 3/12*** | (2006.01) |
| ***E02D 31/02*** | (2006.01) |
| ***E02D 19/00*** | (2006.01) |

(52) U.S. Cl. ..... 405/270; 405/229; 52/169.14; 52/169.5

(58) Field of Classification Search ..... None
See application file for complete search history.

(56) References Cited

U.S. PATENT DOCUMENTS

| | | | |
|---|---|---|---|
| 4,878,421 | A | 11/1989 | Glasser |
| 5,054,252 | A | 10/1991 | Newman |
| 5,642,967 | A | 7/1997 | Swain et al. |

OTHER PUBLICATIONS

Selected Pages from the "Moisture Control Handbook: Principles and Practices for Residential and Small Commercial Buildings" focusing on Foundation Construction in Mixed Climates published in 1991.

Selected Pages from the "Builder's Foundation Handbook" focusing on Crawlspace Construction Techniques published in May 1991 by the U.S. Department of Energy on behalf of the Oak Ridge National Laboratory and authored by the Carmody, Jeffrey Christian, and Kenneth Labs.

Home Energy Magazine Online Article entitled "High Efficiency Homes: Moving Markets Updating Codes" published May/Jun. 1998.

Colorado Department of Public Health and Environment, "Radon (An Environmental Concern With An Easy Solution): A Guide for Installing Affordable Radon Control Systems In New Homes," published Apr. 1999.

Reef Industries, Inc. Product Specifications for Multi–Ply, Fiber Reinforced, Durable Plastic Film Laminate Vapor Barrier Retarders published in 1990, 1995, and 1999.

Craig DeWitt, PhD, PE, "Sealed Crawl Space Specifications," published Aug. 20, 2001 (available at www.rlcengineering.com/ca_specs.pdf).

U.S. Department of Energy Technology Fact Sheet published Dec. 2002.

Energy Design Update Newsletter entitled "Proper Crawlspace Details Clash with Building Codes" published in 1998.

William B. Rose and Anton Ten Wolde, "Moisture Control in Crawl Spaces", Wood Design Focus (Focus: Moisture Control in Residential Structures), vol. 5, No. 4, published during Winter 1994.

(Continued)

*Primary Examiner*—Aaron J. Lewis

(57) ABSTRACT

A system for encapsulating a crawlspace against the entry of sub-soil water vapor and also against the entry of external ground water from the crawlspace walls and for completely isolating the building from water vapor from the earth. The present system comprises applying over the floor of the crawlspace, generally a dirt floor but sometimes a poured concrete floor, a continuous durable sealed plastic film barrier layer or laminate, and extending the barrier film vertically-upwardly to cover and seal the interior peripheral walls enclosing the crawlspace to an elevation at least slightly greater than the elevation of the ground in contact with the exterior surfaces of the peripheral walls and preferably to the tops of the peripheral walls. This encapsulates the dirt surface of the entire crawlspace against the penetration of external ground water or floor water and also sub-soil water and water vapor onto the surface of the plastic barrier film and into the crawlspace atmosphere.

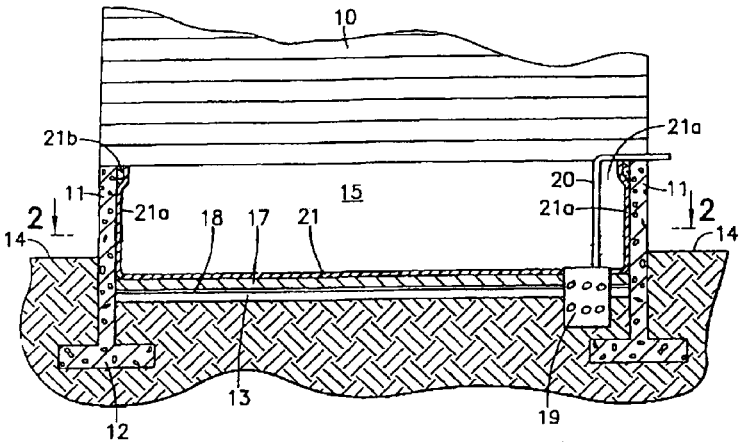

OTHER PUBLICATIONS

L. Stiles and M. Custer, Reduction of Moisture in Wood Joists In Crawl Space—A Study of Seventeen Houses in Southern New Jersey, American Society of Heating, Refrigerating and Air–Conditioning Engineers (ASHRAE) Transactions 1994, vol. 100, Part 1, Paper No. NO–94–19–3, 1314–1324.

Selected Pages from the 1997 ASHRAE Fundamentals Handbook, published in 1997 by the American Society of Heating, Refrigerating and Air–Conditioning Engineers, Inc., pp. 23.11–23.13.

Publication entitled "Vapor Retarders Will Stop Odors and Moisture" from Ask the Builder (www.askthebuilder.com) published on Oct. 18, 1999.

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–13 are cancelled.

* * * * *